US006853326B2

(12) United States Patent
Brasse et al.

(10) Patent No.: US 6,853,326 B2
(45) Date of Patent: Feb. 8, 2005

(54) DATA CONVERTER

(75) Inventors: Dierk Brasse, Schalksmühle (DE); Michael Mandel, Lüdenscheid (DE)

(73) Assignee: Werner Turck GmbH & Co.KG, Halver (DE)

( * ) Notice: Subject to any disclaimer, the term of this patent is extended or adjusted under 35 U.S.C. 154(b) by 61 days.

(21) Appl. No.: 10/464,814

(22) Filed: Jun. 17, 2003

(65) Prior Publication Data

US 2004/0043671 A1 Mar. 4, 2004

(30) Foreign Application Priority Data

Jun. 20, 2002 (DE) ..... 102 27 422

(51) Int. Cl.[7] ..... G08C 19/12
(52) U.S. Cl. ..... 341/190; 341/176; 341/177
(58) Field of Search ..... 341/190, 176, 341/177

(56) References Cited

U.S. PATENT DOCUMENTS 4,597,057 A * 6/1986 Snow ..... 341/190
5,508,703 A * 4/1996 Okamura et al. ..... 341/190

FOREIGN PATENT DOCUMENTS

DE 20015758 3/2002

* cited by examiner

*Primary Examiner*—Michael Tokar
*Assistant Examiner*—Lam T. Mai
(74) *Attorney, Agent, or Firm*—Martin A. Farber

(57) ABSTRACT

A a converter has a head part (1), which can be connected to an external data bus, and one or more connection modules (2), which can be connected to it by way of plug-in mounting in the form of rows. The head part (1) has a plug-in connection (3) with plug-in contacts (4) associated with an internal data bus; each connector module (2) has a counter plug-in connection (5) matching the plug-in connection (3) of the head part (1); counter plug-in contacts (6) of the counter plug-in connection (5) are connected to circuit connection contacts (7) for the connection of a circuit support (8) having an electronic circuit and to plug-in contacts (4) for the connection of the counter plug-in contacts (6) of a further connection module (2); each connection module (2) has at least one device connection (9) for the connection of an actuator or a sensor, which communicates via a bus. Facility of manufacture is provided by a plug-in connection of the connection modules (2) to one another or the connection module (2) to the head (1), and also by a watertight plug-in association of the circuit support (8).

15 Claims, 3 Drawing Sheets

DATA CONVERTER

FIELD AND BACKGROUND OF THE INVENTION

The invention relates to a converter with a head part, which can be connected to an external data bus, and one or more connection modules, which can be connected to it by way of plug-in mounting in the form of rows, with the following features:

- the head part has a plug-in connection with plug-in contacts associated with an internal data bus;
- each connector module has a counter plug-in connection matching the plug-in connection of the head part;
- counter plug-in contacts of the counter plug-in connection are connected to circuit connection contacts for the connection of a circuit support having an electronic circuit and to plug-in contacts for the connection of the counter plug-in contacts of a further connection module;
- each connection module has at least one device connection for the connection of an actuator or a sensor, which communicates via the internal and external bus to a control device which can be connected to the external bus.

A converter of this type is described by DE 200 15 758 U1. The head part, which is also described as a gateway, has a connection with which it can be connected to an external bus. Via this external bus, data are exchanged between the head part and a control device, for example a programmable controller. The external bus may be a field bus or the like. In the gateway, the data which are sent to the converter via the external data bus are converted and passed on via an internal data bus to the connection modules. Data of the internal data bus which are directed to the control device are passed by the gateway to the external bus. A multiplicity of connection modules can be connected to the head part in rows by way of a plug-in connection, it being possible in each case to connect to the head part a first connection module, to which a second connection module can be connected. By means of the plug-in contacts and counter plug-in contacts, the internal data bus is looped through the entire rows of connection modules disposed in rows. Each connection module has a device connection. Via this device connection, digital or analog data can be exchanged with devices, for example actuators or sensors. Each connection module additionally has an electronic circuit, which is associated with a circuit support and is exchangeably associated with the connection module. The circuit of the circuit support is adapted to the respective device to be connected to the connection module.

In the case of the converter of the known type, the plug-in contacts are open in such a way that the converter can be mounted only at protected locations.

It is known to set up the head and the individual connection modules in a row on a top-hat rail. In this case, the association takes place in the direction of extent of the top-hat rail, the plug-in contacts entering one another when the connection modules are pushed against one another. It is also known for the connection modules to be associated with one another in direction in relation to the direction of extent. In this case, contacts engage in one another in a blade-like manner. For this purpose, contact tabs protrude out of the wide side of the connection module, and slide in corresponding slots in the wide side of the neighboring connection module when the connection modules are brought into association with one another.

The invention is based on the object of providing a converter which can be easily produced but at the same time is robust.

SUMMARY OF THE INVENTION

The object is achieved by the invention specified in the claims.

According to the invention the plug-in connection of the connection modules to one another or of the connection module to the head and also the plug-in association of the circuit support are watertight. In particular, it is provided that the plug-in association of the connection modules takes place in a direction transverse to the direction in which the row is disposed, the wide sides of the connection modules having guiding profiles and a seal surrounding the plug-in connections lying in a plane extending perpendicular to the direction of plug-in association. This setup has the consequence that the sealing force can be applied transversely to the direction of extent of the row. This preferably applies to all seals, that is also a seal which concerns the association of the circuit support with the connection module. In this case, the circuit support is preferably seated in a compartment, the opening of which that lies perpendicular to the plane of the plug-in association being able to be sealed in a watertight manner by a cover formed by the circuit support. The opening rim of the plug-in opening for the circuit support consequently lies in a parallel plane with respect to the sealing opening of the seal which is associated with the plug-in connections. In a preferred configuration of the invention, both the head part and the connection nodules can be clipped onto a top-hat rail. The association takes place in the transverse direction in relation to the direction of extent of the top-hat rail. Catch-like latching projections of the connection modules thereby snap under the edge of the top-hat rail. As this happens, the seals which are associated with the plug-in connections are pressed together. With this association, the sealing forces are absorbed by the mounting on the top-hat rail. In order to remove a connection module or a group of connection modules from the top-hat rail, the latching projections snapping under the top-hat rail in the manner of catches can be pulled back by means of an implement. Then the connection modules can be pulled of f the top-hat rail in the transverse direction in relation to the direction of extent of the top-hat rail. As this happens, the plug-in contacts are disengaged. During the plug-in association of one connection module with respect to the last of the row of connection modules or with respect to the head part, the connection module to be brought into its associated position is guided on the wide side of the last connection module. For this purpose, the two connection modules have wide-side profiles interacting with each other. A wide-side profile may be formed as a T-groove or in the form of two T-grooves running parallel to each other. The wide-side profile preferably comprises two. projections which are spaced apart from each other and have an undercut. The wide-side profile, corresponding to this, of a neighboring connection module has a projection which fits into the space between the two projections and from which there extend ribs which fit into the undercuts. Altogether, a dovetail-shaped wide-side profiling is advantageous. The circuit support which can be inserted into the compartment in the connection module may form a five-sided closed housing carrying a circuit board. The circuit board may in this case protrude out of the opening of the housing. With this portion protruding out of the housing, the circuit board can be brought into electrical contact with the circuit connection contacts. For this purpose, the circuit board may have contact portions. These contact portions way be formed by metallized surface portions of the circuit board on which spring contact arms of the circuit connection contacts rest. To seal the compartment in the connection module in a watertight manner by the cover of the circuit support, the rim of the cover may form a groove in which there lies a seal which rests on the opening rim of the compartment. The cover nay be screwed to the compartment. However, association by means of a clip is also envisaged. In a development of the invention it is provided that the connection module has a multiplicity or contact elements. The contact elements form, from the same material, respectively a plug-in contact, a counter plug-in contact and a circuit connection contact. These contact elements may be formed as punched parts and be connected to. This printed circuit board is a circuit board which substantially produces only one conductive connection to the device contacts. Via this printed circuit board and the contact elements, a supply voltage can be passed to the device contacts. The plug-in connection of a last connection module in a row can be sealed in a watertight manner by an end cap. The cover with which the compartment is sealed nay be produced from a transparent material. In the housing of the circuit support there may be a light-emitting diode, which emits light through the transparent cover. Adhesively attached on the inside of the cover there may also be a type plate, which can be read through the transparent cover. The type plate may, however, also be inserted into a pocket of the cover. The connection module itself may comprise two housing parts. These housing parts are connected to each other in a watertight manner at their connecting location. This connection may be a tongue-and-groove connection. However, adhesive bonding or welding of the two housing parts may also be envisaged. The connecting plane of the two housing parts preferably forms a parallel plane in relation to the sealing plane of the plug-in key or the compartment opening. Like the two housing halves, the circuit support may similarly consist of plastic. The individual connection modules can not only be fixed to one another by means of the top-hat rail mentioned. Rather, it is also envisaged to screw the individual connection modules to one another or to screw the first connection module to the head part. The screwing preferably takes place in the region where the two housings overlap, that is where the plug-in connections are plugged together with the counter plug-in connections. In this case, the screw openings for screwing in the screws may be disposed on the inner side of the compartments for pushing in the circuit support. This increases the watertightness. The screws then extend parallel to the plugging direction.

BRIEF DESCRIPTION OF THE DRAWINGS

An exemplary embodiment of the invention is explained below on the basis of accompanying drawings, in which.

DETAILED DESCRIPTION OF THE PREFERRED EMBODIMENT

Figure 1:
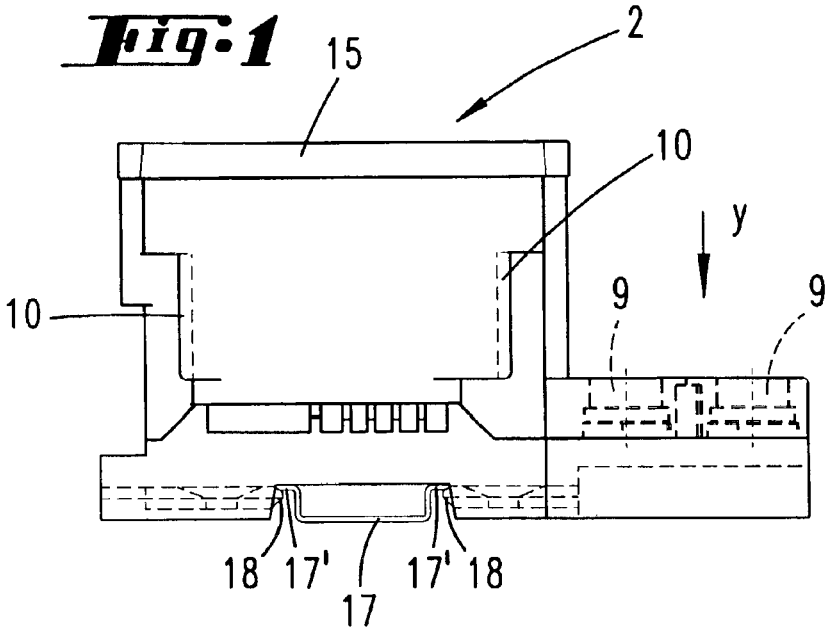
FIG. 1 shows a connection module in elevation.
Figure 2:
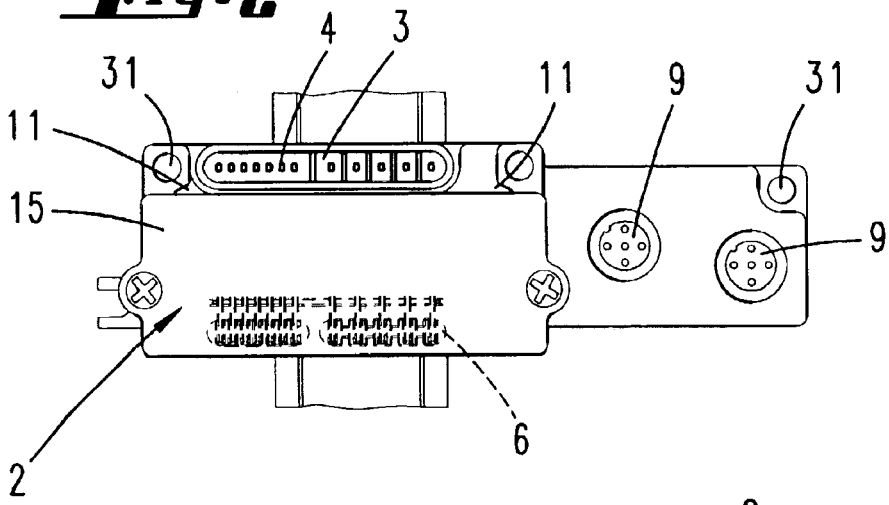
FIG. 2 shows the connection module in a view from above.
Figure 3:
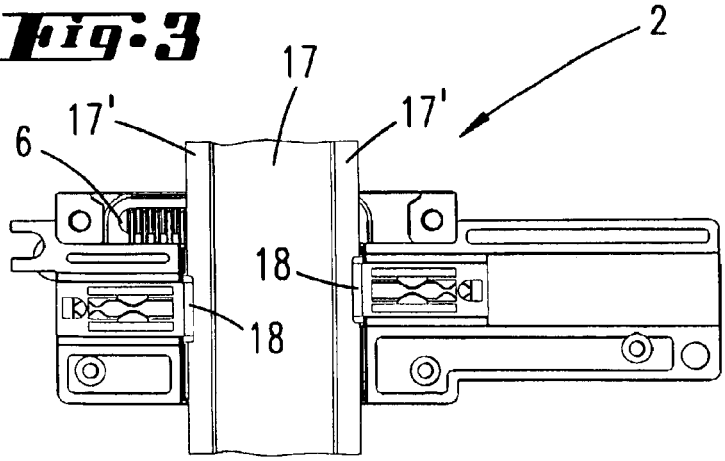
FIG. 3 shows the connection module in a view from below.
Figure 4:
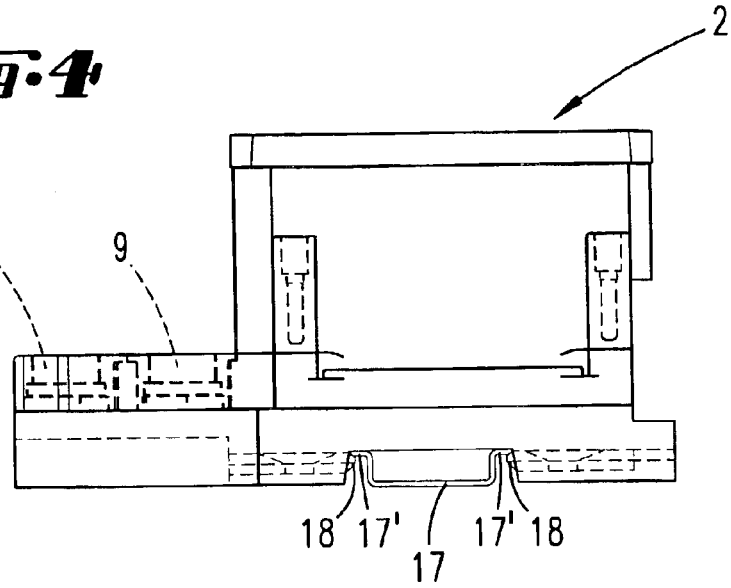
FIG. 4 shows the connection module in a view from the rear according to FIG. 1.
Figure 5:
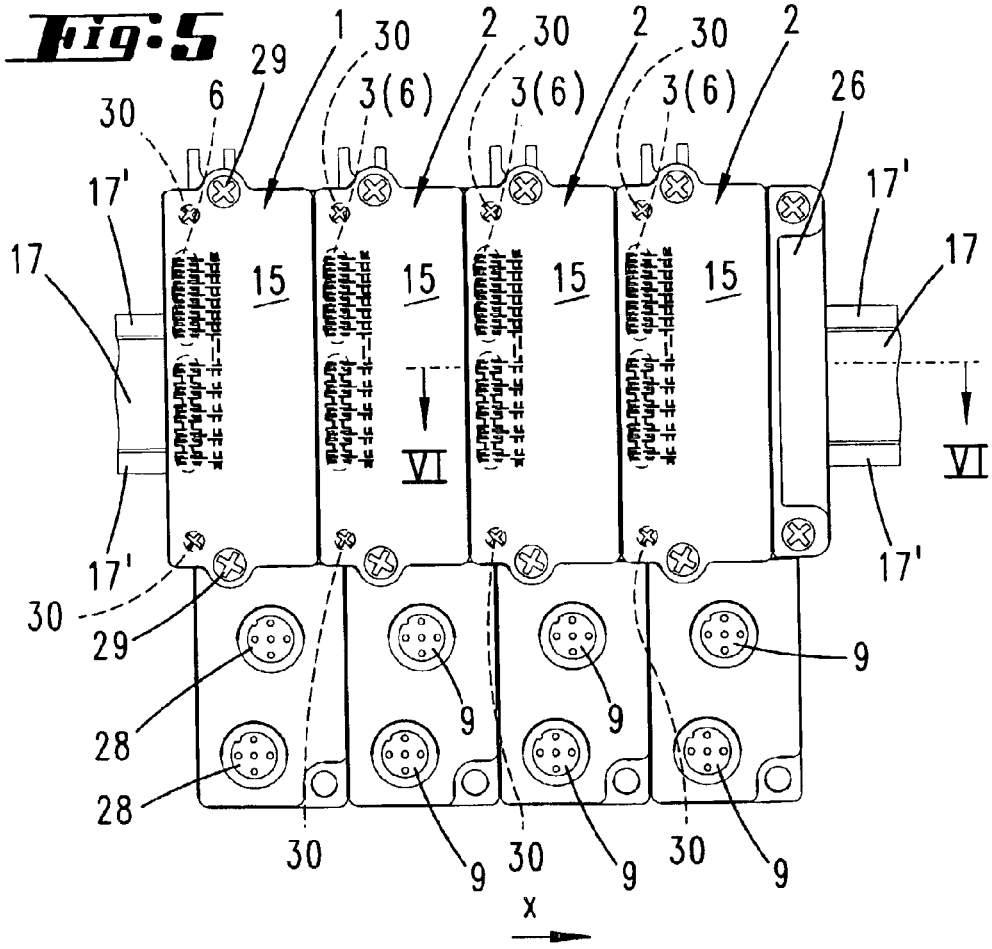
FIG. 5 shows an example of how three connection modules are disposed with a head part and FIG. 6 shows an example of how only two connection modules are disposed, approximately according to the sectional line VI—VI in FIG. 5.

The converter according to the invention generally comprises a multiplicity of connection modules 2, which are set up in a row against one another in a way corresponding to the representation of FIG. 5 on a top-hat rail 17 in the direction of extent x of the top-hat rail 17. The converter has a head part 1, which in the exemplary embodiment has the same outer shape as the connection modules 2 connected to the head part 1. It is also envisaged, however, for the head part 1 to have a different housing form than the connection modules 2. What is important about the head part 1 is that it has one or more external bus connections 28, by means of which the head part can be connected to a central computer. From this central computer, data are sent via the external bus to the head part 1, which is also referred to as a gateway. From the head part 1, data are sent to the central computer. The data received by the head part are obtained by the head part via an internal bus from the individual connection modules. In the same way, the data entering the head part 2. via the external bus are converted in the head part and sent via an internal bus to the associated connection modules 2. Each of the connection modules 2 carries an electronic circuit, by means of which the data intended for the individual connection module 2 can be read from the bus or data can be written to the bus. Each connection module 2 also has one or more device connections 9. These device connections 9 serve for the connection of sensors or actuators. The communication with the sensors or actuators takes place by means of a digital or analog data exchange. The data going out from the connection module 2 to the device (actuators/Sensor) or data received by the device are re-formatted in the connection module.

Figure 6:
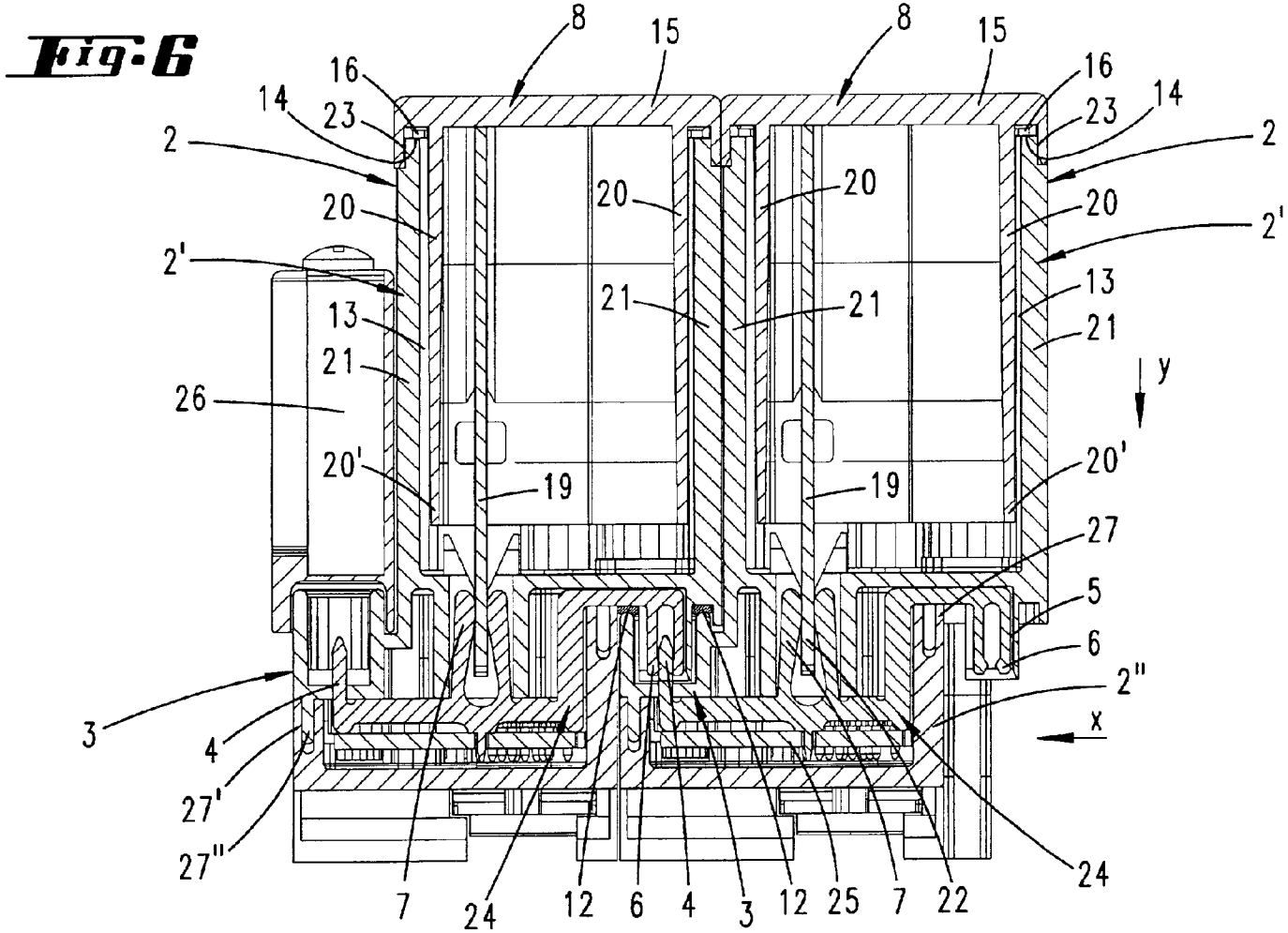

The connection module 2 represented in FIGS. 1 to 5 and in section in FIG. 6 comprises a housing which has two housing parts 2, 2'. The two housing parts 2, 2' are produced as injection-molded parts and are fixedly connected to each other. Along the housing separating line 27 there extends a tongue 27", which belongs to the one housing part 2' and enters into a groove 27', which is associated with the other housing part 2", in such a way that the connection between the two housing parts 2', 2" is watertight. With the connection of the two housing parts 2', 2", an inner cavity is closed. Located within this cavity is a printed circuit board 25, on which a multiplicity of contact elements 24 which are in electrical contact with conductor tracks on the printed circuit board 25 have been applied. A multiplicity of such contact elements 24 are disposed next to one another in the form of a row and form the line for the internal bus and also a voltage supply.

With its housing part 2' the housing 2 forms a compartment 13. A circuit support 8 can be individually inserted into this compartment 13. The circuit support 8 at the same time forms the cover 15, by which the compartment opening of the compartment 13 can be sealed in a watertight manner. In order to seal the opening of the compartment 13 in a watertight manner, a seal 16 rests on the rim 14 of the compartment opening. This annularly closed seal 16 lies in a marginal groove 23 of the cover 15, which can be secured to the housing by means of securing screws 29.

From the cover 15, housing walls 20 of an inner housing, which is fixedly connected to the cover 15, protrude into the compartment 13. Together with the cover 15, these housing walls 20 form a five-sided closed housing. Through the housing opening 20' of the housing 20 there protrudes a circuit board 19, which is held within the housing in a groove. On the circuit board 19 there is an electronic circuit. One end of the circuit board 19 forms connection contact portions 22. These connection contact portions 22 protrude into circuit connection contacts 7 respectively formed by two spring arms, which circuit connection contacts 7 are connected integrally to the contact element 24.

The contact element 24 is formed as a punched part and forms not only the already mentioned circuit connection contacts 7 but also a contact pin 4, which forms a plug-in contact with which the contact element 24 can be brought into conductive connection with an associated contact element 24 of a neighboring connection module 2. This counter contact connection element * 6 is likewise conductively connected to a contact element 24, so that the contact element 24 has altogether at least four contact points, that is on the one hand the plug-in contact 4, the circuit connection contact 7, the counter plug-in contact 6 and on the other hand the contact to the pin on the printed circuit board 25. A multiplicity of contact elements 24 are disposed next to one another.

On the printed circuit board 25, the electrical conductive connections between contacts (not represented) to the circuit board 19 run via the contact elements 24 and the device connections 9, which FIG. 5 reveals.

Located on the underside of the connection module 2 there is a compartment-like depression, which receives the top-hat rail. The top-hat rail 17 has the jutting-out projections 17' typical of it. Behind these projections 17' there engage latching projections 18, which can be displaced out of their latching position in a resiliently movable manner by means of an implement. As a result of this configuration, the connection module 2 can not only be displaced on the top-hat rail in the direction x. It can also be fitted onto the top-hat rail in the direction transverse thereto, in direction y, or pulled off from the top-hat rail by pulling back the latching projections 18 in the opposite direction y.

Underneath the compartment 13, the mentioned counter plug-in contacts 6 are located within a contact carrier portion and altogether form a counter contact connection 5. On the side lying opposite that, the connection module 2 forms a ledge-like projection, which forms a plug-in connection 3 for the internal data bus, with which the plug-in contacts 4 are associated. The plug-in contacts 4 in this case lie in a housing portion of the plug-in connection 3. The socket which carries the counter contact connections 5 can be inserted—as represented in FIG. 6—into a receiving chamber of the plug-in connection 3. As this happens, a seal 12 lying on the marginal edge of the chamber enters into sealing contact with a flange portion surrounding the socket, so that the plug-in connection between the plug-in connection 3 and the counter contact connection 5 is watertight. As a result, all the openings of the connection module 2 of the row are closed in a watertight manner. The last connection module 2 does not have an open plug-in connection 3. The plug-in connection 3 of this last connection module 2 is sealed by an end cap 26.

In order to fix the neighboring connection nodules 2 or the first connection module 2 to the head part 1 in side-to-side contact, the outer compartment walls 21 of the housing 2' have two ribs 10 on one side and two grooves 11 on the opposite side. When the connection modules 2 are brought into their associated position, the ribs enter the grooves formed by undercuts. The grooves 11 and the ribs 10 enter one another in a dovetail-like positive (form-locking) connection.

The planes in which the seals 16 and the seals 12 lie, lie parallel to each other and parallel to the plane of extent of the top-hat rail. In a corresponding way, the direction of association y extends perpendicular to the sealing plane 12.

The connection module 2 has within the housing 20 light-emitting diodes which are not represented in the drawings, are disposed on the circuit board 19 and shine through the transparent cover 15.

As a result of the positive guides formed by the ribs 10 and the grooves 11 interacting with them, association of the connection modules 2 in relation to one another and in relation to the head 1, which forms the gateway, is possible even without the use of a top-hat rail. The connection of two of the connection modules to each other or the connection of the first connection module to the head 1 then takes place by means of screws 30. For this purpose, the projection forming the plug-in contacts 4 has a screw-in opening 31 with an internal thread. There, the portion of the housing 2' of the connection module 2 overlapping this projection in the assembled state has a securing screw through-opening, which is disposed in the region of the base of the compartment 13, so that the securing screw can be inserted into the screw through-opening when the compartment is open, in order to be screwed into the internal thread 31. The securing screw 30 is consequently accessible only when the cover 15 is open.

The transparency of the housing cover 15 also has the advantage that a type plate can be disposed within the cover. The inscription on the type plate can be read through the cover.

All disclosed features are (in themselves) pertinent to the invention. The disclosure content of the associated/attached priority documents (copy of the prior patent application) is also hereby incorporated in full in the disclosure of the patent application, including for the purpose of incorporating features of these documents in claims of the present application.

What is claimed is:

1. Converter having a head part (1) connectable to an external data bus, one or more connection modules (2), connectable to the headpart by way of plug-in mounting in the form of rows, and a circuit support (8) having an electronic circuit, wherein:

the head part (1) has a plug-in connection (3) with plug-in contacts (4) contacting an internal data bus;

each connector module (2) has a counter plug-in connection (5) matching the plug-in connection (3) of the head part (1), and the counter plug-in connection (5) has counter plug-in contacts (6);

counter plug-in contacts (6) of the counter plug-in connection (5) are connected via circuit connection contacts (7) for connection to the circuit support (8) and to plug-in contacts (4) for connection of the counter plug-in contacts (6) of a further one of said connection nodules (2);

each connection module (2) has at least one device connection (9) for connection of an actuator or a sensor that communicates via the internal data bus and the external data bus with a control device connectable to the external bus; and a plug-in connection of the connection modules (2) to one another or of the connection module (2) to the head (1), and also the plug-in association of the circuit support (8) are watertight.

2. Converter according to claim 1, wherein the plug-in association of the connection modules (2) takes place in a direction (y) transverse to a direction (x) in which the row is disposed, wide sides of the connection modules have guiding profiles (10, 11), and a seal (12) surrounding the plug-in connections (3) lies in a plane extending perpendicular to a direction of plug-in association (y).

3. Converter according to claim 2, wherein the circuit support (8) is fitted in a compartment (13), and an opening rim (14) of the compartment lies perpendicular to the direction (y) of the plug-in association to enable sealing in a watertight manner by a cover (15) formed by the circuit support (8).

4. Converter according to claim 1, further comprising a top-hat rail (17), wherein the head part (1) and the connection modules (2) can be clipped onto the top-hat rail (17).

5. Converter according to claim 4, further comprising catch-like latching projections (18) which snap under an edge (17') of the top-hat rail (17) and can be pulled back for the removal of a connection module (2) from the top-hat rail (17).

6. Converter according to claim 2, wherein the wide-side profiles of the connection modules have two undercuts (10) running parallel to each other and also have engagement grooves (11) corresponding to the undercuts.

7. Converter according to claim 3, wherein the circuit support (8) forms a five-sided closed housing, which is insertable into the compartment (13), and carries a circuit board (19), the housing walls (20) of which five-sided housing run parallel to a wall (21) of the compartment, the circuit board protruding out of a housing opening (20'), formed by the housing walls (20), and forming connection contact portions (32), which interact with the circuit connection contacts (7).

8. Converter according to claim 7, wherein the cover (15) forms a groove (23) receiving a seal (16).

9. Converter according to claim 1, further comprising contact elements (24), which form, from the same material, respectively a plug-in contact (4), a counter plug-in contact (6) and a circuit connection contact (7).

10. Converter according to claim 9, further comprising a printed circuit board (25) wherein the contact elements (24) are connected to the printed circuit board (25), with which contacts the device connection (9) connected.

11. Converter according to claim 1, wherein the plug-in connection (3) of a last one of the connection modules (2) of a row is sealed in a watertight manner by an end cap (26).

12. Converter according to claim 7, wherein the cover (15) is transparent and light-emitting diodes are located within the housing walls (20), in particular on the circuit board (19).

13. Converter according to claim 1, wherein the connection module (2) comprises two housing parts (2', 2"), which are connected to each other in a watertight manner at their connecting location (27).

14. Converter according to claim 13, wherein the housing connection (27) includes a plug-in connection having a groove (27') and tongue (27").

15. Converter according to claim 3, further comprising a screw connection of the connection modules to one another, a securing screw through-opening associated with the base of the compartment (13) being in line with a screw-opening (31), which screw-opening (31) is associated with a projection which is overlapped by a housing part (2') of a connection module (2) in such a way that the direction of screwing-in coincides with the direction of plug-in association.

* * * * *